United States Patent [19]

Kazarian et al.

[11] Patent Number: 4,685,818

[45] Date of Patent: Aug. 11, 1987

[54] RIBBON FAULT DETECTION SYSTEM

[75] Inventors: Sam Kazarian, Santa Ana; Steffen D. Hagene, Huntington Beach; Kenneth A. McCrimmon, Jr.; Robert C. Miller, both of El Toro; James A. Schwerin, Chino, all of Calif.

[73] Assignee: Printronix, Inc., Irvine, Calif.

[21] Appl. No.: 776,614

[22] Filed: Sep. 16, 1985

[51] Int. Cl.[4] ..... B41J 35/36

[52] U.S. Cl. ..... 400/249; 400/248

[58] Field of Search ..... 400/121, 219.1, 237, 400/241, 241.1, 248, 249, 708, 708.1; 200/285, DIG. 44

[56] References Cited

U.S. PATENT DOCUMENTS

| | | | |
|---|---|---|---|
| 2,419,369 | 4/1947 | Ritzert | 400/249 X |
| 2,821,284 | 1/1958 | Garwood et al. | 400/249 X |
| 2,992,307 | 7/1961 | Reifel | 200/285 X |
| 3,157,760 | 11/1964 | Yeske | 200/285 X |
| 3,334,585 | 8/1967 | Moran et al. | 400/219.1 X |
| 3,941,051 | 3/1976 | Barrus et al. | 400/121 X |
| 4,084,683 | 4/1978 | Moss | 400/248 X |
| 4,115,013 | 9/1978 | Hedstrom | 400/249 |
| 4,177,731 | 12/1979 | Kleist et al. | 400/219.1 X |
| 4,212,552 | 7/1980 | Bemis et al. | 400/249 |
| 4,310,258 | 1/1982 | Scott | 400/237 X |
| 4,375,339 | 3/1983 | Dyer et al. | 400/249 |
| 4,401,390 | 8/1983 | Melissa et al. | 400/249 X |
| 4,407,593 | 10/1983 | Haftmann | 400/249 X |
| 4,453,839 | 6/1984 | Findlay et al. | 400/241.1 X |

FOREIGN PATENT DOCUMENTS

| | | | |
|---|---|---|---|
| 2163469 | 7/1973 | Fed. Rep. of Germany | 400/219.1 |
| 0208587 | 4/1984 | German Democratic Rep. | 400/708 |
| 0154193 | 12/1980 | Japan | 400/249 |
| 0193386 | 11/1982 | Japan | 400/249 |
| 0160185 | 9/1983 | Japan | 400/249 |
| 0162078 | 9/1984 | Japan | 400/249 |
| 0190884 | 10/1984 | Japan | 400/249 |
| 294707 | 11/1953 | Switzerland | 400/708 |

OTHER PUBLICATIONS

IBM Technical Disclosure Bulletin, "Conductive End of Ribbon Detect Structure", Goff, Jr., vol. 21, No. 6, Nov. 1978, p. 2193, 400/249.

IBM Technical Disclosure Bulletin, "Liquid Lubricant for Flexible Magnetic Recording Tape", Bruce et al, vol. 23, No. 11, Apr. 1981, p. 5155, 400/237.

*Primary Examiner*—Ernest T. Wright, Jr.

*Attorney, Agent, or Firm*—Bogucki, Scherlacher, Mok & Roth

[57] ABSTRACT

A ribbon fault detection system within an impact printer has a pair of resilient electrical contacts disposed in spaced-apart relation across the width of an ink ribbon within each of a pair of ribbon guides located between the opposite ends of a print station and a pair of spools for receiving the opposite ends of the ink ribbon and driving the ink ribbon. Each of the electrical contacts which is silicone coated to minimize ink migration and which is normally held out of engagement with a mating contact due to engagement by the ribbon is coupled in parallel with the other resilient electrical contacts so that closure of any one of the resilient electrical contacts onto its mating contact will generate an indication of a ribbon fault condition. A ribbon fault condition which may be caused by a folded ribbon or other undesired condition and which closes one or more of the contacts turns on a transistor via an operational amplifier having a capacitor coupled thereacross to provide a desired delay in turning on the transistor and which is coupled through a Zener diode to further control the conduction and nonconduction of the fault indicating transistor.

14 Claims, 12 Drawing Figures

RIBBON FAULT DETECTION SYSTEM

BACKGROUND OF THE INVENTION

1. Field of the Invention

The present invention relates to ink ribbon fault detection systems, and more particularly to systems within impact printers for detecting certain ink ribbon fault conditions such as a folded ribbon.

2. History of the Prior Art

It is known to provide arrangements within impact printers for detecting ribbon fault conditions. An example of one such arrangement is provided by U.S. Pat. No. 4,177,731 of Kleist et al which is commonly assigned with the present application. The Kleist et al patent describes a dot matrix impact printer in which a length of ink ribbon is bidirectionally driven via a pair of spools through a print station where the ribbon is impacted against a platen-supported print paper by the actuated hammers of a reciprocating hammer bank. A pair of motors coupled to the two different spools are driven by a circuit which includes apparatus for detecting certain ribbon fault conditions such as a run-away ribbon, a jammed ribbon or a loose hub at one of the spools.

In the printer arrangement described in the previously referred to Kleist et al patent the ribbon fault conditions sensed thereby are capable of electronic detection such as by way of monitoring the motor currents. A problem arises however where it is desired to detect certain ribbon fault conditions which do not readily lead themselves to electronic detection such as by sensing variations in current, voltage or other circuit parameters. One such fault condition is a folded ribbon. During the driving of the length of ribbon through the print station between the opposite spools, it sometimes happens that the ribbon begins to fold over upon itself along a portion of the length thereof. This may be caused by movement of the ribbon over the guides therefor or by various other factors. When a folded portion of a length of ribbon reaches the print station, the results are typically disastrous. Some hammers of the hammer bank impact the paper through multiple thicknesses of the ribbon while still other hammers may bypass the ribbon completely when impacting the paper with the result that nothing is printed on the paper. At the same time movement of the ribbon and operation of the spool motors continues in routine fashion, with the result that electronic sensing arrangements of the type described in Kleist et al do not sense that a fault is present.

Another fault condition which is difficult to detect electronically using the motor drive circuit is that of a billowing or otherwise non-flat ribbon. As ribbons get old, they tend to billow out in certain places, leading to certain printing difficulties including in particular printing nonuniformity. Still other ribbon fault conditions which may be difficult to detect by exclusively electronic means include ribbon snag which occurs when one or more of the print hammers temporarily snags the ribbon upon impact thereof. This will cause the trailing portion of the ribbon to slacken with undesired results. At the same time the attendant changes in tensioning along the leading and trailing portions of the ribbon may not be sufficient to trigger a ribbon fault condition via the motor drive circuit until at least some faulty printing has occurred.

Accordingly, it would be desirable to provide an improved ribbon fault detection system.

It would furthermore be desirable to provide an improved ribbon fault detection system capable of detecting fault condition such as a folded ribbon, a billowing ribbon and a snagged ribbon.

It would still furthermore be desirable to provide a ribbon fault detection system capable of distinguishing between genuine fault conditions and conditions which might otherwise signal a fault condition due to such things as reversals in the direction of ribbon drive.

BRIEF DESCRIPTION OF THE INVENTION

Ribbon fault detection systems in accordance with the invention utilize a plurality of ribbon sensing devices for insuring the presence of a ribbon at each of a plurality of locations across the width of the ribbon when the ribbon is properly positioned within the ribbon path. Accordingly, if the ribbon begins to fold over, the absence of the ribbon adjacent one edge of the proper ribbon path is sensed so as to indicate a fault condition in spite of the presence of the ribbon in the region adjacent the opposite edge of the ribbon path. The ribbon sensing devices are coupled in parallel to a circuit such that any one of the sensing devices is capable of signaling a ribbon fault condition. The circuit provides a predetermined delay between actuation of one of the ribbon sensing devices and the signaling of a ribbon fault condition in order to prevent false signaling in response to such things as reversal in the direction of ribbon drive, and the circuit is designed to control the conduction of a transistor therein signaling the presence of the ribbon fault condition in a manner which provides near uniformity in the conditions involved in turning the transistor on and off.

In one preferred arrangement of a ribbon fault detection system according to the invention, each of a pair of ribbon guides disposed between different ones of the opposite ends of a print station within an impact printer and different ones of an opposite pair of spools for the ribbon is provided with a pair of resilient electrical contacts disposed in spaced-apart fashion across the width of the ribbon so that each of such contacts is normally held in a position away from a common mating contact against the resiliency thereof by the presence of the ribbon thereat. The outer surfaces of the contacts which are engaged by the ribbon are covered with a thin layer or film of silicone to minimize transfer of ink from the ribbon to the contacts. If the ribbon begins to fold over at one edge thereof, the contact adjacent such edge eventually is released from engagement by the ribbon and engages the common mating contact so as to close one of the two switches formed by the pair of resilient electrical contacts and the common mating contact within the ribbon guide. Still other fault conditions such as a billowing or snagged ribbon may cause one or both of the switches within the guide to close.

The pair of switches within each of the two guides present in the ribbon deck of the printer are coupled in parallel to a circuit which includes an operational amplifier and a transistor coupled to be biased into conduction and nonconduction by the condition at the output of the operational amplifier. Upon closure of any one or more the switches indicating that a ribbon fault condition may be present, a capacitor coupled between the output and one of the inputs of the operational amplifier delays the turning on of the transistor by a predetermined period of time in order to distinguish between legitimate fault conditions and shorter transient conditions such as may occur during reversal in the direction of ribbon drive. A Zener diode coupled between the operational amplifier and the transistor helps to equalize the conditions under which the transistor is turned on and off.

BRIEF DESCRIPTION OF THE DRAWINGS

The foregoing and other objects, features and advantages of the invention will be apparent from the following more particular description of a preferred embodiment of the invention, as illustrated in the accompanying drawings, the which.

DETAILED DESCRIPTION OF THE INVENTION

Figure 1:
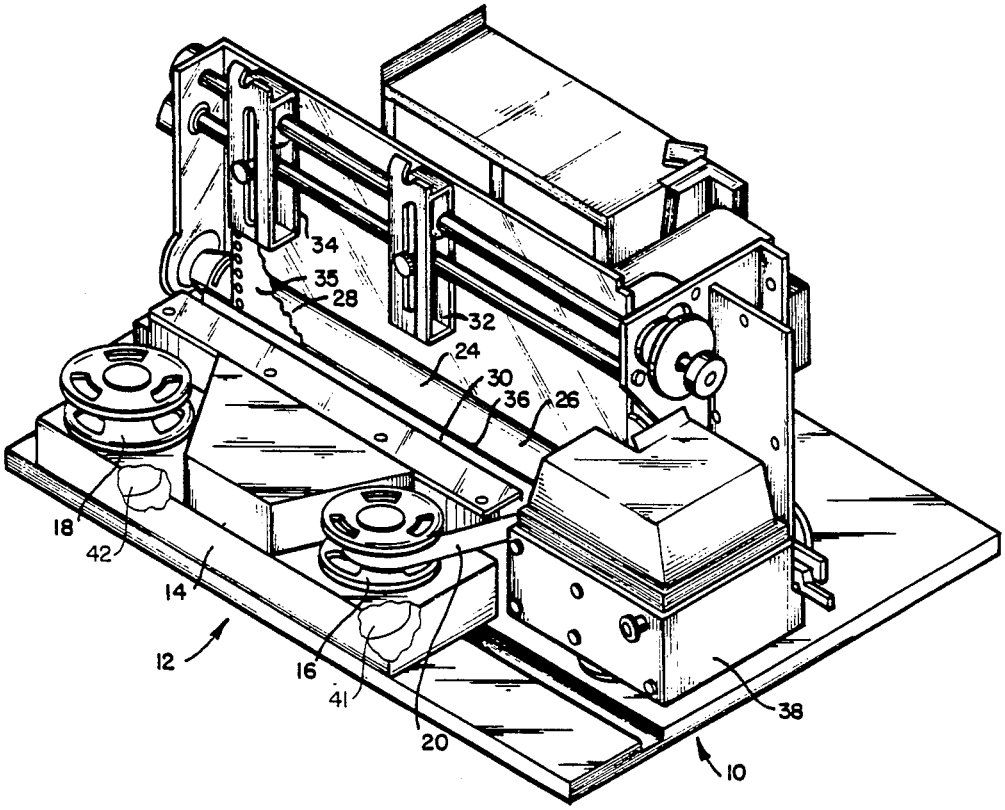
FIG. 1 is a perspective view of a printer having a ribbon fault detection system according to the invention.

FIG. 1 depicts a printer 10 having a ribbon fault detection system 12 in accordance with the invention. The ribbon fault detection system 12 forms a part of a ribbon deck 14 having an opposite pair of ribbon spools 16 and 18 rotatably mounted thereon. The spools 16 and 18 receive the opposite ends of a length of ink ribbon 20.

An elongated platen 24 of generally cylindrical configuration is mounted within the printer 10 adjacent the ribbon deck 14. A relatively narrow space between the platen 24 and the ribbon deck 14 and extending along the length of the platen 24 between opposite ends 26 and 28 of the platen 24 forms a part of a print station 30 for the printer 10.

A pair of opposite tractor drives 32 and 34 mounted within the printer 10 are operative to incrementally advance a length of print paper 35 (only a small portion of which is shown in FIG. 1 for clarity) upwardly through the print station 30 along the side of the platen 24. The ribbon 20 extends through the print station 30 adjacent the print paper 35 on the opposite side of the print paper 35 from the platen 24. An elongated shuttle assembly 36 which is mostly hidden from view in FIG. 1 by the rear portion of the ribbon deck 14 and which is shown in dotted outline in FIG. 2 extends along the print station 30 adjacent the ribbon 20 on the opposite side of the ribbon 20 from the print paper 35 and the platen 24. As shown by the broken-away portion of FIG. 2, the shuttle assembly 36 contains an elongated hammer bank 37 having a pluarlity of print hammers 39 mounted in side-by-side relation along the length of the shuttle assembly 36. The shuttle assembly 36 is driven in bidirectional reciprocating fashion through the print station 30 by a shuttle drive 38 shown in FIG. 1.

The printer 10 prints in dot matrix impact fashion by selectively actuating or "firing" the hammers 39 of the hammer bank 37 contained within the shuttle assembly 36 during each movement of the shuttle assembly 36 by the shuttle drive 38 through the print station 30. As each hammer 39 is actuated a dot printing impact tip 40 mounted thereon and shown in FIG. 2 impacts the ribbon 20 against the print paper 35 on the surface of the platen 24 to print a dot. Upon completion of each movement of the shuttle assembly 36 through the print station 30, the direction of drive of the shuttle assembly 36 by the shuttle drive 38 is reversed and at the same time the tractor drives 32 and 34 increment the print paper 35 upwardly by a dot position in preparation for the printing of a next row of dots.

Except for the presence of the ribbon fault detection system 12 which forms a part of the ribbon deck 14, the printer 10 as shown and described is conventional in nature. Details of such a printer are shown and described by way of example in U.S. Pat. No. 3,941,051 of Barrus et al which is commonly assigned with the present application and which is incorporated herein by reference.

During operation of the printer 10 a pair of motors 41 and 42 mounted within the ribbon deck 14 as shown in the broken-away portions of FIG. 1 drive the spools 16 and 18 so as to advance the ribbon 20 in either of opposite directions through the print station 30. Typically, the spools 16 and 18 are rotated in one direction to feed the ribbon 20 between the spools 16 and 18. When the end of the ribbon 20 is reached, the direction of drive of the spools 16 and 18 is reversed and the ribbon 20 is fed in an opposite direction between the spools 16 and 18. When the end of the ribbon 20 is again reached, the direction of drive of the spools 16 and 18 is reversed and the process is repeated. A detailed example of the ribbon deck 14 as thus described together with a circuit for driving the spool motors is provided by previously referred to U.S. Pat. No. 4,177,731 of Kleist et al which is incorporated herein by reference.

Figure 2:
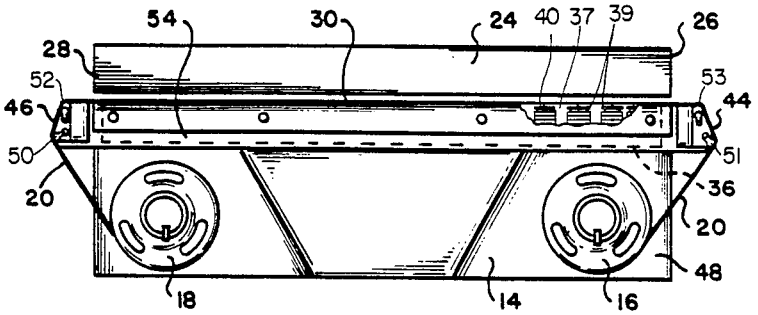
FIG. 2 is a top view of the ribbon deck and certain adjacent portions of the printer of FIG. 1.
Figure 3:
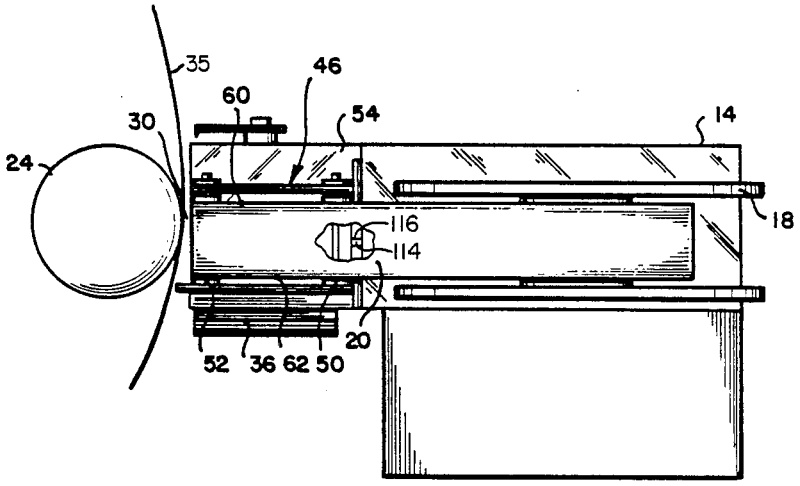
FIG. 3 is an end view of the apparatus shown in FIG. 2.

As shown in FIGS. 2 and 3 as well as in FIG. 1, the ribbon deck 14 includes a pair of ribbon guides 44 and 46 mounted adjacent the opposite ends of the print station 30. The ribbon guide 44 is mounted on one end of a housing 48 for the ribbon deck 14 between the spool 16 and the end 26 of the platen 24 so as to form a path for and guide the ribbon 20 from the spool 16 into the adjacent end of the print station 30. The ribbon guide 46 is mounted on the housing 48 at the opposite end of the print station 30 and adjacent the end 28 of the platen 24 so as to form a path for and guide the ribbon 20 between that end of the print station 30 and the spool 18. The ribbon guide 46 which is shown in FIG. 3 is provided with an opposite pair of guide posts 50 and 52 for directing the ribbon 20 from the spool 18 through two different angular bends prior to entering the print station 30. The guide posts 50 and 52 which are for the most part obscured by the ribbon 20 in FIG. 3 are shown and described in detail hereinafter. Similarly, the ribbon guide 44 is provided with a pair of guide posts 51 and 53 for directing the ribbon 20 from the spool 16 through two angular bends prior to entry of the ribbon 20 into the print station 30.

The housing 48 of the ribbon deck 14 is provided at the rear thereof with an elongated, generally rectangular cover 54 extending across the print station 30 between the ribbon guides 44 and 46 which are mounted at the opposite ends thereof. The cover 54 is disposed over and partly encloses the shuttle assembly 36 containing the elongated hammer bank 37 as previously described. As the shuttle assembly 36 is reciprocated bidirectionally relative to the print station 30, the individual hammers 39 of the hammer bank 37 therein are selectively actuated causing the dot printing impact tips 40 mounted thereon to impact the ribbon 20 against the length of print paper 35 supported by the platen 24. At the same time the ribbon 20 is driven first in one direction and then in the opposite direction between the opposite ends thereof by the spools 16 and 18 and the associated drive motors 41 and 42 as previously described.

As described in detail hereafter in connection with FIGS. 4–12, the ribbon guide 46 is provided with a ribbon sensing switch assembly 70 which includes a pair of resilient electrical contacts 76 and 78 disposed in spaced-apart relation across the width of the desired path for the ribbon 20 so as to sense the presence or absence of the ribbon 20 at locations adjacent each of the opposite edges of the desired path that the ribbon 20 normally assumes at the ribbon guide 46. As shown in FIG. 3 the ribbon 20 has an upper edge 60 and a lower edge 62. When the ribbon 20 assumes the proper position at the guide 46, the upper edge 60 of the ribbon 20 lies at the upper edge of a ribbon path through the guide 46, and similarly the lower edge 62 of the ribbon 20 lies at the lower edge of the ribbon path through the guide 46. The ribbon guide 44 is of like but reversed configuration and functions in the same manner as the ribbon guide 46.

As described hereafter (but not shown in FIG. 3) the ribbon guide 46 includes an upper switch contact 76 for sensing the presence of the ribbon 20 adjacent the upper edge of the ribbon path and a lower switch contact 78 for sensing the presence of the ribbon 20 adjacent the lower edge of the ribbon path. Each of the switch contacts 76 and 78 is sensitive to the presence or absence of the ribbon 20 thereat. Accordingly the upper switch contact 76 within the ribbon guide 46 will generate a ribbon fault signal when the ribbon 20 is not present thereat even through the ribbon 20 is present at the lower switch contact 78. The ribbon guide 44 is of like but reversed configuration to the ribbon guide 46. As described hereafter the upper and lower switch contacts 76 and 78 of of the ribbon guide 46 are coupled in parallel so that the closure of either of the switch contacts 76 and 78 generates a ribbon fault signal.

FIGS. 4–7 show the ribbon guide 46 in detail. The ribbon guide 46 includes a frame 64 mounting the guide posts 50 and 52 at the opposite ends thereof. The guide posts 50 and 52 are generating parallel to each other as well as being spaced-apart across the width of the frame 64 and comprise elongated, generally cylindrical elements mounted in nonrotating fashion on the frame 64. The guide post 52 has opposite disk-shaped flanges 66 and 68 rotatably mounted thereon at the upper and lower ends thereof respectively to help guide the ribbon 20 across the ribbon guide 46.

The ribbon guide 46 is provided with the ribbon sensing switch assembly 70 that includes a contact plate 72 mounted by a screw 74 on a central portion of the front of the frame 64. The contact plate 72 forms both the upper resilient electrical contact 76 and the lower resilient electrical contact 78. The upper contact 76 extends across a portion of the frame 64 below and adjacent the position which the upper edge 60 of the ribbon 20 assumes when the ribbon 20 is properly positioned within the ribbon path across the ribbon guide 46. The lower contact 78 is positioned above and adjacent the lower edge of the ribbon path as defined by the lower edge 62 of the ribbon 20 when the ribbon 20 is in the desired position.

Figure 7:
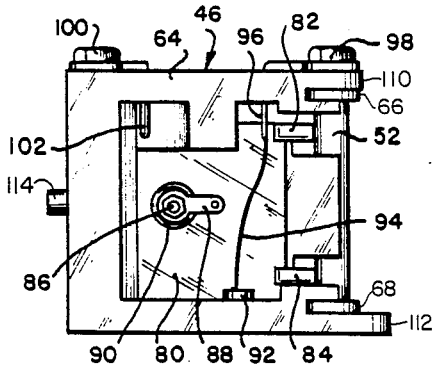
FIG. 7 is a rear view of the ribbon guide of FIG. 4.
Figure 6:
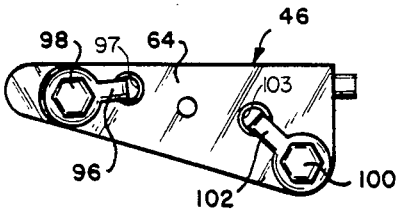
FIG. 6 is a top view of the ribbon guide of FIG. 4.

As shown in FIG. 7 the ribbon guide 46 is provided with a contact plate 80 disposed on the opposite side of the frame 64 from the contact plate 72 which forms the contacts 76 and 78. Each of the contacts 76 and 78 terminates in an outer end which curves around one end of the frame 64 between the frame 64 and the guide post 52 and terminates in a tip 82 or 84 disposed adjacent the contact plate 80. As shown in FIG. 7 the upper contact 76 terminates in the tip 82, while the lower contact 78 terminates in the tip 84. The contact plate 70 is comprised of resilient as well as electrically conductive material, and the upper and lower contacts 76 and 78 normally extend outwardly from the frame 64 such that the tips 82 and 84 thereof are resiliently biased into contact with the common contact plate 80.

As previously noted the contact plate 72 is mounted on the frame 64 by the screw 74. The screw 74 which engages and thereby makes electrical contact with the contact plate 72 extends through the thickness of the frame 64 to the opposite side. At the opposite side of the frame 64 the screw 74 receives a nut 86 which engages a terminal 88 against an insulating washer 90 disposed between the terminal 88 and the contact plate 80. The washer 90 insulates the screw 74, the nut 86 and the terminal 88 from the contact plate 80. The terminal 88 provides electrical connection to the upper and lower contacts 76 and 78.

Electrical connection to the contact plate 80 is provided by a terminal 92 formed at a lower edge of the contact plate 80. The terminal 92 is coupled via a wire 94 to a terminal 96. The terminal 96 which is grounded in the present example extends through an aperture 97 in the upper part of the frame 64 to the top of the frame 64 where it is disposed beneath and in contact with a screw 98 secured to the upper end of and mounting the guide post 52 within the frame 64. In this manner the guide post 52 is electrically grounded as well as the contact plate 80.

The guide post 50 has an upper end which extends through a top part of the frame 64 and is secured therein by a screw 100. The screw 100 engages a terminal 102 which extends along a portion of the top of the frame 64 and then through an aperture 103 therein to a region above and adjacent the contact plate 80 as shown in FIG. 7. The terminal 102 provides for electrical connection to the guide post 50. Thus, with the guide post 52 electrically grounded via the terminal 96, the terminal 102 is used to sense the presence of an electrical contact strip 104 (shown in dotted outline in FIG. 9) at each of the opposite ends of the length of ribbon 20. Each such contact strip 104 is long enough to extend across both of the guide posts 50 and 52 when the end of the ribbon 20 is reached. The resulting grounding of the terminal 102 via the extension of the contact strip 104 across the guide posts 50 and 52 is used to signal that the end of the ribbon 20 has been reached and to reverse the direction of drive of the spools 16 and 18.

Figure 8:
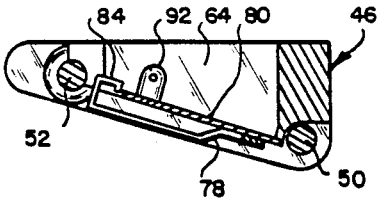
FIG. 8 is a sectional view taken along the line 8—8 of FIG. 5 and illustrating the engaged position normally assumed by the mating switch contacts of the ribbon guide when no ribbon is present thereat.
Figure 10:
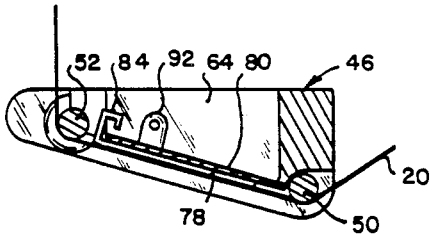
FIG. 10 is a sectional view similar to the view of FIG. 8 but showing the unengaged position assumed by the mating switch contact when a ribbon is present thereat.

As previously noted the upper and lower contacts 76 and 78 which are of resilient material extend outwardly from the frame 64 on one side thereof so as to hold the tips 82 and 84 thereof on the other side of the frame 64 in contact with the common contact plate 80. FIG. 8 which is a sectional view of FIG. 5 taken along the line 8—8 thereof depicts the lower contact 78 and its tip 84 when in such a position. The upper contact 76 and its tip 82 assume a similar position. However, when the ribbon 20 is present at the contacts 76 and 78, the tips 82 and 84 associated with the contacts 78 and 80 are held out of engagement with the contact plate 80. This is illustrated in FIG. 10 which is a sectional view similar to that of FIG. 8 but with the ribbon 20 present. This feature is utilized in accordance with the invention to sense the presence or absence of the ribbon 20 at the upper contact 76 and at the lower contact 78 independently.

Figure 9:
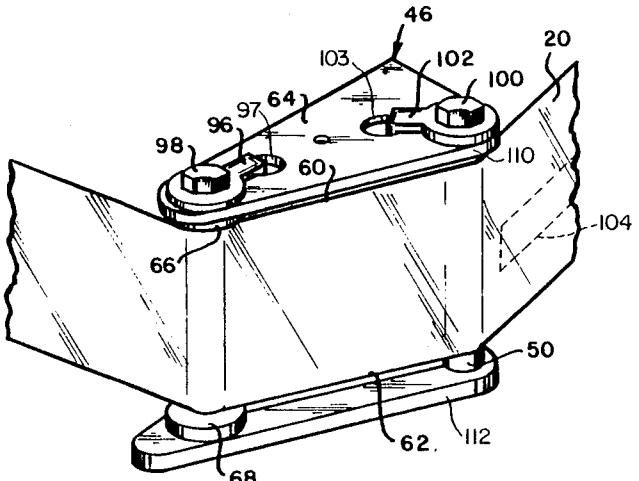
FIG. 9 is a perspective view of the ribbon guide of FIG. 4 with a ribbon in place thereon.
Figure 4:
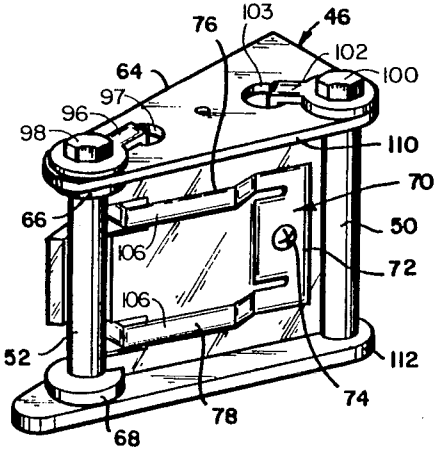
FIG. 4 is a perspective view of one of the two ribbon guides of the apparatus shown in FIG. 2.
Figure 5:
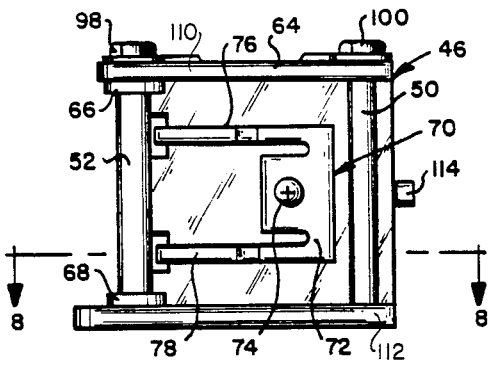
FIG. 5 is a front view of the ribbon guide of FIG. 4.

The guide posts 50 and 52 define the portion of the ribbon path therebetween. Such path is generally planar and defines the position that the ribbon 20 assumes when it is stretched relatively tautly between the guide posts 50 and 52. This is the condition that the ribbon 20 assumes in normal operation within the ribbon deck 14 during which the ribbon 20 is driven in either of the opposite directions between the guide posts 50 and 52. This is illustrated in FIGS. 9 and 10 which emphasize that when the ribbon 20 is properly positioned within the portion of the ribbon path extending between the guide posts 50 and 52, both of the tips 82 and 84 of the contacts 76 and 78 are held out of engagement with the contact plate 80.

Figure 11:
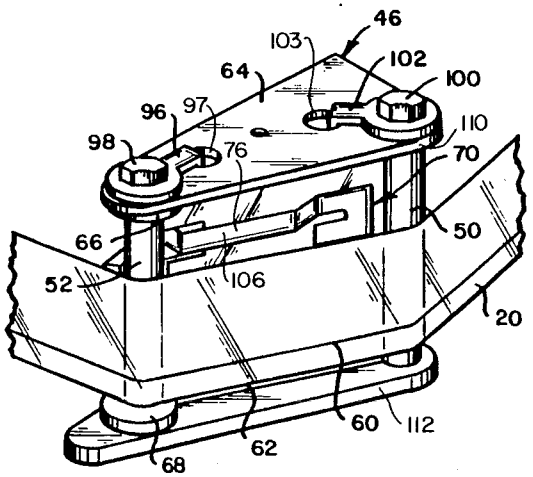
FIG. 11 is a perspective view of the ribbon guide of FIG. 4 illustrating a folded ribbon condition.

The upper contact 76 is disposed adjacent the upper edge 60 of the ribbon 20 when the ribbon 20 is properly positioned within the ribbon path between the guide posts 50 and 52. Similarly, the lower contact 78 is positioned adjacent the lower edge 62 of the ribbon 20 with the ribbon 20 properly positioned within the ribbon path. Each of the contacts 76 and 78 senses the presence or absence of an adjacent portion of the ribbon 20 to the exclusion of other portions of the ribbon 20. This feature is utilized in accordance with the invention to signal ribbon fault conditions. One such condition which is a folded ribbon is illustrated in FIG. 11. In the folded ribbon condition so illustrated the upper portion of the ribbon 20 has begun to fold over the lower portion such that the upper edge 60 is disposed close to the lower edge 62. The ribbon 20 is no longer disposed over and in contact with the upper contact 76. Consequently the upper contact 76 has sprung outwardly under its natural resilience such that the tip 82 thereof engages the contact plate 80 so as to complete an electrical circuit between the terminals 88 and 96.

If the lower edge 62 of the ribbon 20 begins to fold over an upper portion of the ribbon 20, then eventually the lower contact 78 will no longer be engaged by the ribbon 20 and will spring outwardly so as to complete a circuit between the terminals 88 and 96 and thereby ground the terminal 88.

Certain ribbon conditions can occur in which both the upper contact 76 and the lower contact 78 engages the contact plate 80. In that event the result is the same, namely the terminal 88 is coupled to the terminal 96 and thereby grounded.

The arrangement of the contacts 76 and 78 is effective in detecting ribbon fault conditions in that it responds to the absence of a portion of the ribbon 20 as well as to the absence of the entire ribbon 20 itself. Upon occurrence of the ribbon fold condition illustrated in FIG. 11, one of the contacts 76 and 78 may engage and thereby complete an electrical circuit with the common contact plate 80 even though portions of the ribbon 20 engage the other one of the contacts 76 and 78. The ribbon 20 may sometimes billow, particularly as it ages. The billowing can occur across the entire width of the ribbon 20 or only over a relatively small portion thereof. Such billowing may allow one or both of the contacts 76 and 78 to spring outwardly. If the billowing is great enough one or both of the contacts 76 and 78 will engage and complete a circuit with the common contact plate 80 to signal that a fault condition exists.

Still other ribbon fault conditions are readily detected by the ribbon guide 46. If the ribbon 20 breaks or slips completely off of the guide 46, then both contacts 76 and 78 engage and complete circuits with the common contact plate 80. Snagging of the ribbon 20 by one or more of the hammers 39 within the shuttle assembly 36 or other jamming condition may cause the ribbon 20 to become slack in the region of the ribbon guide 46. If sufficient slackness occurs, then one or both of the contacts 76 and 78 may spring outwardly far enough to complete a circuit with the common contact plate 80.

Proper detection of the folded ribbon condition such as shown in FIG. 11 requires the presence of at least two contacts such as the contacts 76 and 78 across the width of the ribbon 20. On the other hand the number of contacts need not be limited to two and, if so desired, three or more contacts could be located in spaced-apart relation across the width of the ribbon 20.

During normal operation of the ribbon deck 14 the ribbon 20 is in continuous engagement with the contacts 76 and 78 of the ribbon guide 46 and the corresponding pair of contacts 126, 128 (FIG. 12) of the ribbon guide 44 which has a configuration reversed from but otherwise like that of the ribbon guide 46. This may result in a tendency for substantial quantities of ink to migrate from the ribbon 20 onto the contacts where the ink may begin to build up on such contacts in excessive quantities and in some cases transfer back onto other portions of the ribbon 20. To minimize ink migration from the ribbon 20 onto the contacts such as the contacts 76 and 78, it has been found advantageous to coat the outer surfaces of the contacts 76 and 78 with a low coefficient of friction material that is basically nonpermeable to the ink. Silicone has been found to be ideally suited for this purpose and can be coated onto the outer surfaces of the contacts 76 and 78 so as to form thin layers 106 thereon.

As shown in FIGS. 4–11 the frame 64 has upper and lower flanges 110 and 112 disposed adjacent and yet spaced apart from the upper and lower edges 60 and 62 of the ribbon 20 respectively. The upper flange 110 has the disk-shaped flange 66 rotatably mounted immediately below it, while the lower flange 112 has the disk-shaped flange 68 rotatably mounted immediately above it. The frame 64 also has a small cylindrical projection 114 extending from one end thereof. The projection 114 is received within an aperture 116 in an end of the cover 54 of the ribbon deck 14 to mount the ribbon guide 46 thereon.

Figure 12:
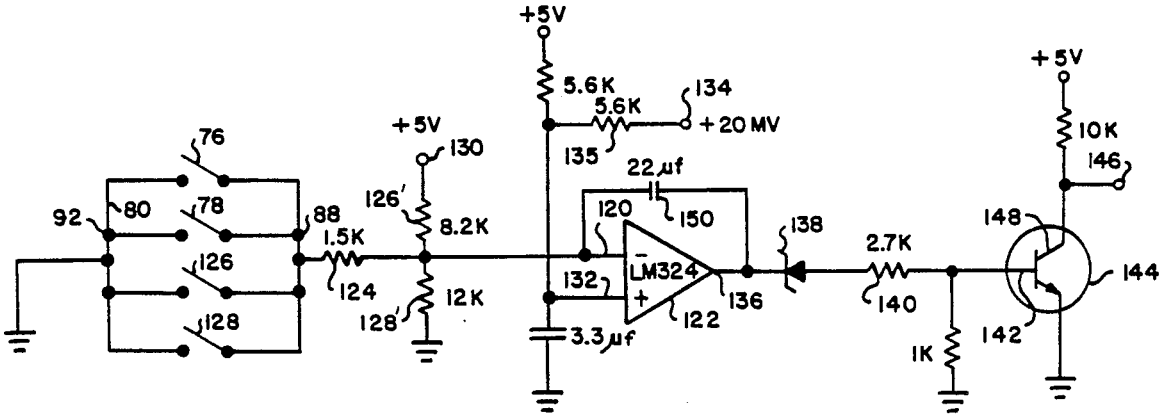
FIG. 12 is a schematic diagram of a ribbon fault detecting circuit forming part of the printer of FIG. 1 and utilized with the apparatus shown in FIG. 2.

FIG. 12 shows a ribbon fault detection circuit in accordance with the invention. The contacts 76 and 78 of the ribbon guide 46 are coupled in parallel in the circuit of FIG. 12 as are two corresponding contacts 126 and 128 of the ribbon guide 44. In this manner any one or more of the four contact 76, 78, 126 and 128 is capable of signaling a ribbon fault condition such as where the ribbon 20 begins to fold so as to move away from one of the four contacts 76, 78, 126 and 128. As shown in FIG. 12 the terminal 92 of the contact plate 80 is coupled to ground as previously noted. The terminal 88 is coupled to an input 120 of an operational amplifier 122 via a resistor 124. This couples the contacts 76 and 78 in parallel between ground and the input 120. The ribbon guide 44 has a pair of contacts 126 and 128 shown in FIG. 12 which are similarly coupled in parallel between ground and the input 120 of the operational amplifier 122.

The input 120 of the operational amplifier 122 is coupled to the junction between a pair of resistors 126' and 128' which are serially coupled between a voltage source 130 and ground. In the absence of closure of one of the contacts 76, 78, 126 and 128 such arrangement provides approximately +3 volts at the input 120 which is the negative input of the operational amplifier 122. The operational amplifier 122 also has a positive input 132 which is coupled to a voltage source 134 via a resistor 135. The voltage source 134 typically has a nominal operating voltage of approximately +20 millivolts thereat. This is considerably less than the approximately +3 volts at the negative input 120, and an output 136 of the operational amplifier 122 remains at low voltage.

The output 136 is coupled through a Zener diode 138 and a resistor 140 to a base terminal 142 of a transistor 144. With each of the contacts 76, 78, 126 and 128 remaining open, the lower voltage at the output 136 of the operational amplifier 122 biases the transistor 144 into nonconduction and the resulting signal at an output terminal 146 coupled to a collector terminal 148 of the transistor 144 indicates the absence of a ribbon fault condition.

When a ribbon fault condition exists, one or more of the contacts 76, 78, 126 and 128 is closed so as to ground the input 120 of the operational amplifier 122. With the input 120 being grounded, the positive input 132 is of higher voltage and this tends to make the voltage at the output 136 rise so as to bias the transistor 144 into conduction. However, the rise of the voltage at the output 136 does not occur instantaneously and is controlled by a capacitor 150 coupled between the output 136 and the negative input 120 of the operational amplifier 122. The presence of the capacitor 150 causes the operational amplifier 122 to operate as an integrator, with the result that the voltage at the output 136 rises gradually in response to the closure of one or more of the contacts 76, 78, 126 and 128. In the present example one or more of the contacts 76, 78, 126 and 128 must be closed for approximately 300 milliseconds before the voltage at the output 136 rises to a level sufficient to bias the transistor 144 into conduction. With the transistor 144 conducting, the signal at the output terminal 146 indicates that a ribbon fault condition is present. Where desired, the signal at the output terminal 146 can be coupled to terminate operation of the printer 10 along with giving a visual or other warning identifying the nature of the problem.

The predetermined delay providing by the capacitor 150 distinguishes legitimate ribbon fault conditions from other conditions which might otherwise erroneously trigger a ribbon fault condition. For example approximately 150 ms are required each time ribbon turnaround occurs. During each turnaround the ribbon 20 may become slack long enough for one or more of the contacts 76, 78, 126 and 128 to close. Also, the electrical contact strips 104 at the opposite ends of the ribbon 20 can produce false indications. Because of the delay provided by the capacitor 150, such closure of one or more of the contacts 76, 78, 126 and 128 is of insufficient duration to bias the transistor 144 into conduction.

The Zener diode 138 tends to equalize the conduction and nonconduction of the transistor 144 in response to signals at the output 136 of the operational amplifier 122. More specifically, the Zener diode 138 balances the "off" and "on" times of the fault signal. Although the output 136 of the operational amplifier 122 rises from approximately ground to about 25 volts upon closure of one or more of the contacts 76, 78, 126 and 128, the transistor 144 need have only approximately 0.7 volts applied to the base terminal 142 thereof to be biased into conduction. In the absence of the Zener diode 138 the voltage at the output 136 would only have to increase by a few tenths of a volt to turn on the transistor 144. By the same token the output 136 would have to decrease by over 20 volts to turn the transistor 144 off. The presence of the Zener diode 138 requires that the voltage at the output 136 increase to aQproximately 19 volts before the transistor 144 is turned on. Accordingly, the turn on and turn off times of the transistor 144 are made approximately equal by the presence of the Zener diode 138.

While the invention has been particularly shown and described with reference to a preferred embodiment thereof, it will be understood by those skilled in the art that various changes in form and details may be made therein without departing from the spirit and scope of the invention.

What is claimed is:

1. A ribbon deck comprising the combination of:

a pair of spools;

means for rotatably driving the pair of spools;

means defining a ribbon path between the pair of spools;

at least one sensing member disposed adjacent the ribbon path and having a plurality of ribbon sensing elements for sensing the absence of a ribbon at different locations across the ribbon path between positions occupied by opposite edges of a ribbon when a ribbon is disposed within the ribbon path, each of the ribbon sensing elements including a resilient element disposed on one side of and biased to extend through the ribbon path into a first position in the absence of a ribbon thereat so as to complete electrical contact to a contact element positioned spaced-apart from and on said one side of the ribbon path, the resilient element being held against the resiliency thereof in a second position against the side of a ribbon when a ribbon is present thereat; and means coupled to the plurality of ribbon sensing elements for indicating a ribbon fault condition in response to completion of electrical contact to the contact element of any one of the plurality of ribbon sensing elements.

2. The invention as set forth in claim 1, wherein the ribbon path extends through an elongated print station having opposite ends, the at least one sensing member is disposed adjacent one of the opposite ends of the print station, and further including a second sensing member disposed adjacent the other one of the opposite ends of the print station, the second sensing member having a plurality of ribbon sensing elements for sensing the absence of a ribbon at different locations across the ribbon path between positions occupied by opposite edges of a ribbon when a ribbon is disposed within the ribbon path and being of like configuration to the at least one sensing member.

3. The invention as set forth in claim 1, wherein the sensing member comprises a switch and the plurality of ribbon sensing elements comprises two of the resilient elements, each of the resilient elements comprising an electrical contact which is disposed adjacent a different one of the positions occupied by opposite edges of a ribbon when a ribbon is disposed within the ribbon path.

4. The invention as set forth in claim 3, wherein the switch comprises a part of a ribbon guide which includes a pair of elongated, generally parallel posts for receiving a ribbon thereon, the posts being disposed on opposite sides of the two contacts.

5. A ribbon guide for use with a ribbon deck comprising the combination of:

a frame having opposite ends;

a pair fo elongated guide elements mounted on the frame at the opposite ends of the frame and defining a ribbon path therebetween having opposite edges defining the approximate location of the opposite edges of a ribbon when a ribbon extends through the ribbon path and over the pair of elongated guide elements; and a plurality of ribbon sensing elements mounted within the ribbon path in spaced-apart relation across the ribbon path between the opposite edges of the ribbon path, each of the ribbon sensing elements being operative to provide an electrical signal in resposne to the absence of a ribbon thereat and comprising a resilient electrical contact element mounted on the frame on one side of the ribbon path and a mating contact element mounted on said one side of the ribbon path, the resilient electrical contact element normally assuming a first position relative to the frame in which the resilient electrical contact element engages the mating contact element and being resiliently biased into a second position relative to the frame in which the resilient electrical contact element is spaced-apart from the mating contact element when a ribbon is disposed over and extends relatively tautly between the pair of elongated guide elements.

6. The invention as set forth in claim 5, wherein the mating contact element of each of the ribbon sensing elements comprises a contact plate mounted on the frame on said one side of the ribbon path in a position in which the contact plate is contacted by the resilient electrical contact element when the resilient electrical contact element assumes the first position.

7. The invention as set forth in claim 6, wherein the resilient electrical contact element comprises a resilient, electrically conductive metal element having a film of silicone on an outer surface thereof.

8. The invention as set forth in claim 5, wherein each of the pair of elongated guide elements comprises a generally cylindrical post which is generally parallel to the other one of the pair of elongated guide elements and the plurality of ribbon sensing element include a first electrical contact element disposed within the ribbon path adjacent one of the opposite edges of the ribbon path and a second electrical contact element disposed within the ribbon path ajacent the other one of the opposite edges of the ribbon path.

9. The invention as set forth in claim 8, wherein the first and second electrical contact elements are each comprised of a different one of a pair of elongated, resilient, electrically conductive elements extending from a common base mounted on the frame and terminating in an outer end and further including a contact plate forming the mating contact element, the contact plate being mounted on the frame and disposed in the path of the outer end of each of the pair of elongated, resilient, electrically conductive elements.

10. A printer having a ribbon fault detection system and including the combination of:

an elongated platen having a pair of opposite ends;

a length of ink ribbon;

a pair of spools for containing opposite ends of the length of ink ribbon;

means for rotatably driving the pair of spools to drive the length of ink ribbon in either of opposite directions between the pair of spools;

a pair of ribbon guides, each of which is disposed between a different one of the pair of spools and a different one of the pair of opposite ends of the elongated platen and including at least one guide element for receiving the length of ink ribbon thereon and at least two ribbon sensing elements spaced-apart across the width of the length of ink ribbon, each of the ribbon sensing elements including a resilient element disposed on one side of and biased to extend into the length of ink ribbon, the resilient element assuming a first position in the absence of an ink ribbon thereat so as to complete electrical contact to a contact element positioned spaced-apart from and on said one side of the length of ink ribbon, the resilient element being held against the resiliency thereof in a second position against the side of an ink ribbon when an ink ribbon is present thereat; and a fault detecting circuit coupled to each of the ribbon sensing elements and being operative to provide a ribbon fault signal when the length of ink ribbon is not present at each of the ribbon sensing elements.

11. The invention as set forth in claim 10, wherein the fault detecting circuit includes a circuit for delaying the providing of a ribbon fault signal until the length of ink ribbon has been sensed by one of the ribbon sensing elements as not being present thereat for a predetermined period of time.

12. The invention as set forth in claim 10, wherein each of the ribbon sensing elements comprises an electrical switch coupled in parallel with switches comprising the other ribbon sensing elements to the fault detecting circuit.

13. A circuit for detecting a fault condition in a ribbon deck comprising the combination of:

an operational amplifier having first and second inputs and an output;

means for providing a reference voltage at the first input of the operational amplifier;

a plurality of switches, each of which is arranged to close upon occurrence of a fault condition;

means for coupling the plurality of switches in parallel to the second input of the operational amplifier;

a transistor having a base terminal coupled to the output of the operational amplifier and arranged to be biased into conduction in response to a signal of predetermined value at the output of the operational amplifier to indicate a fault condition; and a capacitor coupled between the output and the second input of the operational amplifier, the capacitor being operative to delay the occurrence of the signal of predetermined value at the output of the operational amplifier in response to the closing of one of the plurality of switches.

14. The invention as set forth in claim 13, further including a Zener diode coupled between the output of the operational amplifier and the base terminal of the transistor.

* * * * *